US005378435A

United States Patent [19]

Gavoni

[11] Patent Number: 5,378,435

[45] Date of Patent: Jan. 3, 1995

[54] SILENCER COMBINED WITH CATALYTIC CONVERTER FOR INTERNAL COMBUSTION ENGINES AND MODULAR DIAPHRAGM ELEMENTS FOR SAID SILENCER

[75] Inventor: Albino Gavoni, Milan, Italy

[73] Assignee: Gavoni B. G. M. Silenziatori Di Albino Gavoni & C. S.a.s., Milan, Italy

[21] Appl. No.: 136,495

[22] Filed: Oct. 14, 1993

Related U.S. Application Data

[63] Continuation of Ser. No. 922,048, Jul. 29, 1992, abandoned.

[30] Foreign Application Priority Data

Sep. 4, 1991 [IT] Italy ..... MI 91A 002347
Mar. 5, 1992 [IT] Italy ..... MI 92U 000206

[51] Int. Cl.[5] ..... F01N 1/08; B01D 53/34

[52] U.S. Cl. ..... 422/177; 422/171; 422/176; 60/299; 181/264; 181/272

[58] Field of Search ..... 422/171, 176, 177, 179, 422/180; 55/DIG. 30, DIG. 21; 60/299; 181/264, 272, 248

[56] References Cited

U.S. PATENT DOCUMENTS

| | | | |
|---|---|---|---|
| 2,330,534 | 9/1943 | Wood | 181/272 |
| 3,600,142 | 8/1971 | Fessler | 422/176 |
| 3,644,098 | 2/1972 | DePalma et al. | 422/176 |
| 3,649,213 | 3/1972 | DePalma et al. | 422/176 |
| 3,719,457 | 3/1973 | Nagamatsu | 422/176 |
| 3,749,130 | 7/1973 | Howitt et al. | 422/176 |
| 3,780,772 | 12/1973 | Carnanhan et al. | 60/299 |
| 3,852,042 | 12/1974 | Wagner | 60/299 |
| 3,853,484 | 12/1974 | Sudar et al. | 60/299 |
| 4,050,903 | 9/1977 | Bailey et al. | 422/177 |
| 4,056,934 | 11/1977 | Mizusawa et al. | 181/264 |
| 4,094,644 | 6/1978 | Wagner | 422/181 |
| 4,094,645 | 6/1978 | Bailey | 60/299 |
| 4,122,913 | 10/1978 | Stemp | 181/264 |
| 4,160,010 | 7/1979 | Ottle | 60/299 |
| 4,211,302 | 7/1980 | Matthews et al. | 181/248 |
| 4,225,561 | 9/1980 | Torres | 422/177 |
| 4,226,298 | 10/1980 | Bancel et al. | 181/264 |
| 4,632,216 | 12/1986 | Wagner et al. | 181/272 |
| 4,797,263 | 1/1989 | Oza | 60/299 |
| 4,809,812 | 3/1989 | Flugger | 181/272 |
| 4,900,517 | 2/1990 | Domesle et al. | 422/171 |
| 5,136,923 | 8/1992 | Walsh, Jr. | 89/14.2 |

FOREIGN PATENT DOCUMENTS

| | | |
|---|---|---|
| 0420521 A1 | 4/1991 | European Pat. Off. . |
| 334071 | 12/1958 | Switzerland . |

OTHER PUBLICATIONS

Search report from the European Patent Office dated Aug. 24, 1993.

*Primary Examiner*—Robert J. Warden
*Assistant Examiner*—Hien Tran
*Attorney, Agent, or Firm*—Merchant, Gould, Smith, Edell, Welter & Schmidt

[57] ABSTRACT

The silencer combined with a catalytic converter comprises a housing including an inner tubular element in which a catalytic converter is fitted. The engine exhaust gases enter into the silencer through a venturi nozzle, flowing through a series of diaphragms made of porous ceramic material treated with catalytic materials, and flow out from an exhaust outlet of the silencer depleted of pollutants. The ceramic diaphragms may be cup shaped and provided with through-holes or ogive shaped with perforated walls and they may consist of elements formed by a plate provided with lateral flanges forming opposite cavities. The elements may be combined with one another in different manners to form a sequence of chambers with shape and volume best suited for each type of engine.

10 Claims, 4 Drawing Sheets

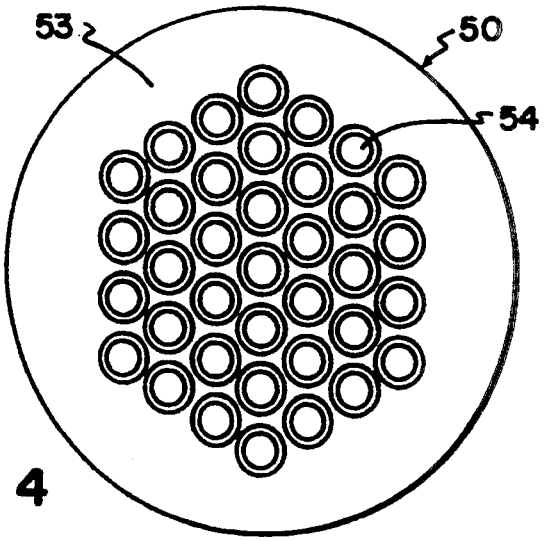
FIG. 4
FIG. 7
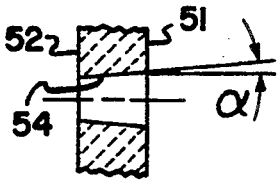
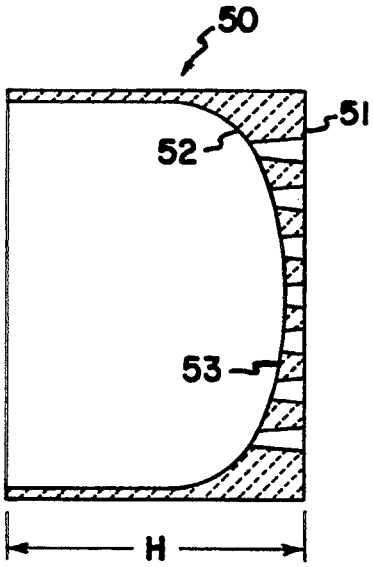
FIG. 3
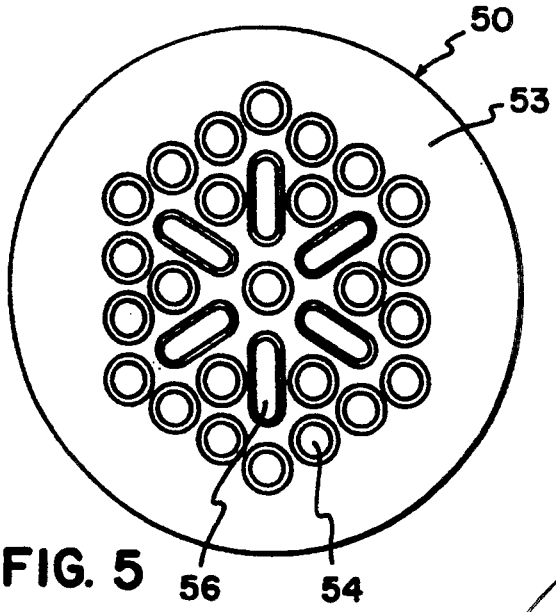
FIG. 5
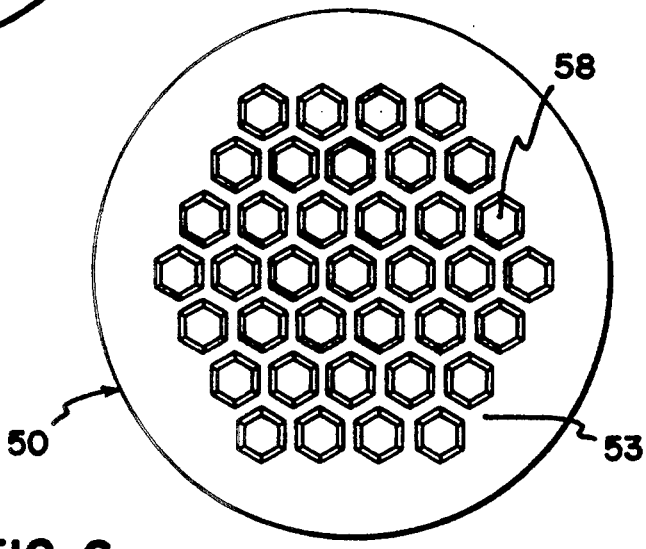
FIG. 6

SILENCER COMBINED WITH CATALYTIC CONVERTER FOR INTERNAL COMBUSTION ENGINES AND MODULAR DIAPHRAGM ELEMENTS FOR SAID SILENCER

This is a continuation of application Ser. No. 07/922,048, filed Jul. 29, 1992, now abandoned.

BACKGROUND OF THE INVENTION

This invention relates to a silencer combined with a catalytic converter apt to convert the exhaust gases originating from internal combustion engines of any type into less harmful gases.

The harmful effects of exhaust gases discharged into the atmosphere by internal combustion engines has been evidenced since many years and the rapid increase in the number of motor vehicles in circulation has compelled the more industrialized countries to issue restrictive measures aimed at minimizing the emission of carbon monoxide, unburnt hydrocarbons and nitrogen oxide. As a consequence, catalysts have been developed which, when distributed over a large surface in contact with the exhaust gas stream, are suitable for converting these very polluting agents into substantially harmless gases, such as carbon dioxide, water vapour and nitrogen. On grounds of this knowledge, various kinds of catalytic converters to be fitted upstream of the conventional silencers have been developed and marketed.

These converters, however, present various problems such as the duration of their chemical efficiency related to the mechanical lifetime of their structure and to the complexity of the structure itself which lead to very high costs as well as to installation difficulties.

Whilst, in future, as a rule, vehicles will have to be factory-fitted with exhaust cleaners, the cost of the latter hampers both the installation on new vehicles and the conversion of the enormous number of already existing vehicles.

Catalytic converter-mufflers are already known in the art. For instance, U.S. Pat. No. 3,649,213 describes a catalytic converter-muffler device having a V-shaped bed configuration providing optimum gas flow characteristics and minimization of differential expansion problems from high-temperature conditions. A preferred unit has an oval outer chamber, a catalyst reservoir section, and curved sidewalls for the internal catalyst retaining screens so as to preclude buckling which occurs with flat plate members.

A combination muffler and catalytic converter having low back pressure is disclosed in U.S. Pat. No. 4,094,645. The device incorporates a venturi in the exhaust gas inlet path to add secondary air. The efficiency of the venturi is quite high since back pressures introduced downstream of the venturi are kept low by providing an extremely long outlet cone for the venturi which reverses the flow direction while preventing wall separation and turbulence. Sound attenuation is provided upstream of the venturi where the back pressures produced have a minimum effect in reducing venturi efficiency.

A housing for a catalytic medium supported on a metal foil and a catalytic converter containing such supported catalytic medium is described in EP-A-0263893. The catalytic converters are said to be especially useful for internal combustion engines whether spark ignited or compression ignited and especially for automotive vehicles.

An apparatus for catalytic or other purification of exhaust gases of internal combustion engines, with two exhaust gas treating bodies and a protection ring between them, is disclosed in EP-A-0387422.

None of these prior art devices anticipate the specific design of the converter-silencer of the instant invention.

SUMMARY OF THE INVENTION

Object of the present invention is that of providing a silencer including a catalytic converter of low manufacturing cost and long life, for cleaning the exhaust gases whereby the catalytic converter can be replaced together with the silencer without any installation problems, thereby performing both functions, viz. silencing and exhaust cleaning in one.

According to the invention, the combined silencer/-converter consists of an outer housing, fitted in a known manner at the exhaust gas inlet end, with a fitting to the engine exhaust manifold and in which housing is fixed a catalytic converter mounted inside a tubular element. The latter is provided, at one end, upstream of the exhaust gas flow, with an open end into which extends said fitting, forming a venturi nozzle, while the opposite end is closed by a wall to which the silencer exhaust is connected. In the part of said tubular element comprised between the end of the venturi nozzle and its terminal wall are inserted a plurality of elements made of porous ceramic material treated with catalytic material for depleting the exhaust gas of the pollutants. It is suggested that the diaphragms be provided with suitable ports for the passage of the exhaust gases, while successive expansion chambers for the gases are provided between one diaphragm and the next, so that said gases may be discharged from the end diffuser not only depleted of the pollutants but also at a temperature and pressure close to ambient so that the assembly acts also as an efficient silencer, thereby being easily replaceable as a single unit in like manner as the conventional silencer of any type of vehicle, with minimum installation cost.

The form of the porous ceramic diaphragms is conceived so that said diaphragms may be inserted in succession with matching joints or fittings, maintaining intervals and distances predetermined in the laboratory and optimized for each of the numerous vehicle models in circulation, considering that the invention is not dedicated exclusively, although mainly, to replacements on the numerous types of vehicles in circulation.

In other words, the catalytic silencer may be manufactured in a short time, without tying up capital and utilizing excessive space, in an assortment of heterogeneous silencers readily available for the great variety of existing vehicles. Evident advantage offered by the catalytic silencers is the possibility of keeping in stock a limited quantity of internal and external components of predetermined size and which can be assembled according to specifications based on laboratory tests whereby to offer the most suitable type of silencer depending on the cubic capacity, the power and the type of vehicle.

As it will be apparent from the description and the appended claims, the present invention is not directed to the specific chemical nature or physical properties of the ceramic materials suitable for making the filtering elements of the instant invention, nor is the invention directed to the selection of a specific catalytic material or class of materials. In fact, both ceramic materials and catalytic media for converting CO, HC and $NO_x$ are well known in the art.

Just by way of example, typical useful ceramic materials are represented by inorganic refractory oxides such as alumina, gamma-alumina, alumina-zirconia, zirconia, silica, cordierite, mullite, carbides such as silicium carbide, nitrides and the like. Examples of suitable catalytic materials are platinum, palladium, silver, oxides such, as iron oxide, vanadium oxide, chromium oxide, and in general suitable catalytic media may well include other metals of groups I, V, VI and VIII of the Periodic Table, as it is well known to those skilled in the art. Known is also the fact that these catalytic materials may be used singly or in combination with two or more of them. Also the way of treating the porous ceramic materials with the catalytic media is well known in the art and is outside the scope of the present invention.

The invention will now be described with reference to the attached drawings which are illustrative of the inventive idea but which shall not be construed restrictively.

BRIEF DESCRIPTION OF THE DRAWINGS

FIG. 3 is a cross-section of a type of ceramic diaphragm;

FIGS. 4 to 6 are rear elevation views of the inventive perforated diaphragm walls;

FIG. 7 shows, in particular, in cross-section, one of the diverging holes of a diaphragm;

DETAILED DESCRIPTION OF THE PREFERRED EMBODIMENT

Figure 1:
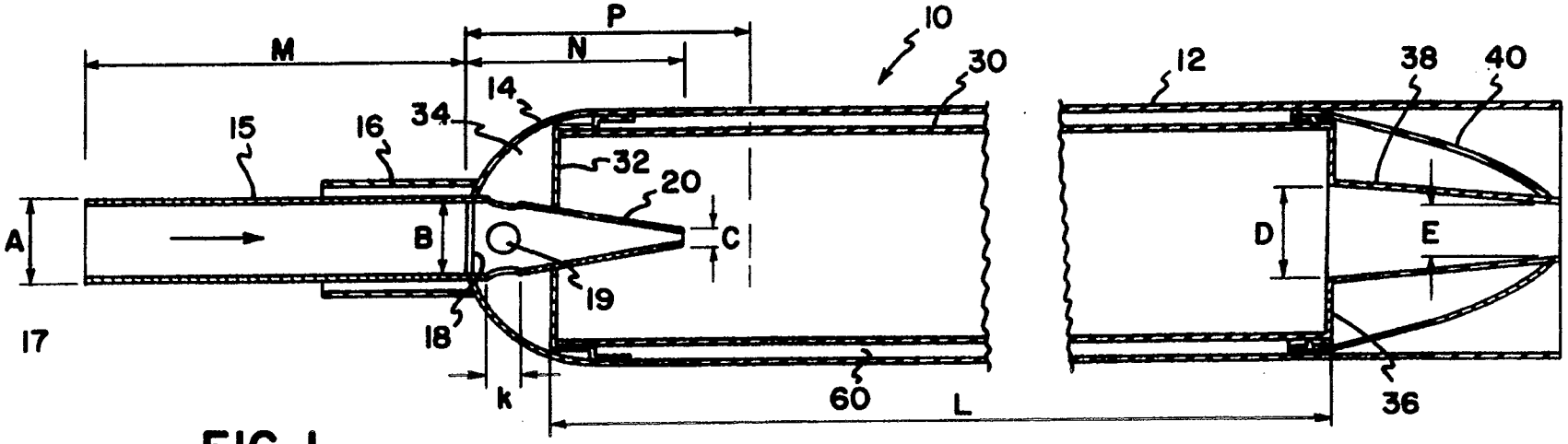
FIG. 1 illustrates schematically, in axial cross-section, the housing of the combined silencer/catalytic converter according to the invention, provided with an engine exhaust gas inlet nozzle and a rear exhaust diffuser, but without the inner diaphragms.

FIG. 1 shows the body of the silencer, identified, in its entirety, by number 10 and consisting of an outer housing 12 terminating at one end with a substantially semispherical head 14, provided with a conical fitting 15, partly surrounded by a sleeve 16, which fitting engages the exhaust manifold of the engine. Within housing 12 is located a tubular element 30 containing, as it will be seen hereinafter, the catalytic elements suitably arranged, which tubular element has one end 32 open towards chamber 34 formed by the semispherical head 14, while at the opposite end, closed by a wall 36, a convergent exhaust tube 38 is connected, housed in an ogive 40, which acts as a diffuser for the exhaust of the gas into the atmosphere and which terminates substantially in line with the outer housing 12.

The fitting 15 of length M has preferably a taper of 13% starting from its inlet section 17, of diameter A, up to section 18 which coincides with the entry of the semispherical chamber 34 and in which diameter B has the following value:

$$B=2(A/2-M\times 0.13). \quad (1)$$

The fitting 15, located inside chamber 34, is gradually tapered to form a convergent duct or venturi nozzle 20, the end diameter C of which has the following value:

$$C=B/3.5 \quad (2)$$

developing inside the chamber itself for a length N equal to:

$$N=\frac{B-C}{2\tan 10^\circ}. \quad (3)$$

The venturi nozzle 20 is provided with at least four transversal holes 19 cut out in the proximity of its connection zone with the semispherical head 14 and from which part of the gas is discharged into the catalytic converter, while the remaining part is discharged from the end hole, leading to an internal decompression.

Diameter K of holes 19 has the following value:

$$K=\sqrt{\frac{(B^2-C^2)}{4}} \quad (4)$$

The average length P of the front chamber, including partially semispherical chamber 34, up to the wall of the first diaphragm, is:

$$P=\frac{HP\times 400\times K}{B^2\times \pi/4} \quad (5)$$

where HP is the engine horsepower.

$K$ = 2.6 for 4 cylinder engines
= 6.8 for 4 cylinder engines
= 12.5 for 12 cylinder engines.

For Diesel engines the indicated K values must be further multiplied by a factor of 4.25.

The end diffuser 38 has, towards the inside of tube 30, the following diameter:

$$D=\sqrt{\frac{S_F}{0.785}}$$

where $S_F$ represents the overall area of the holes in the terminal diaphragm facing the last chamber formed in the tube 30, as will be described hereinafter.

Figure 2:
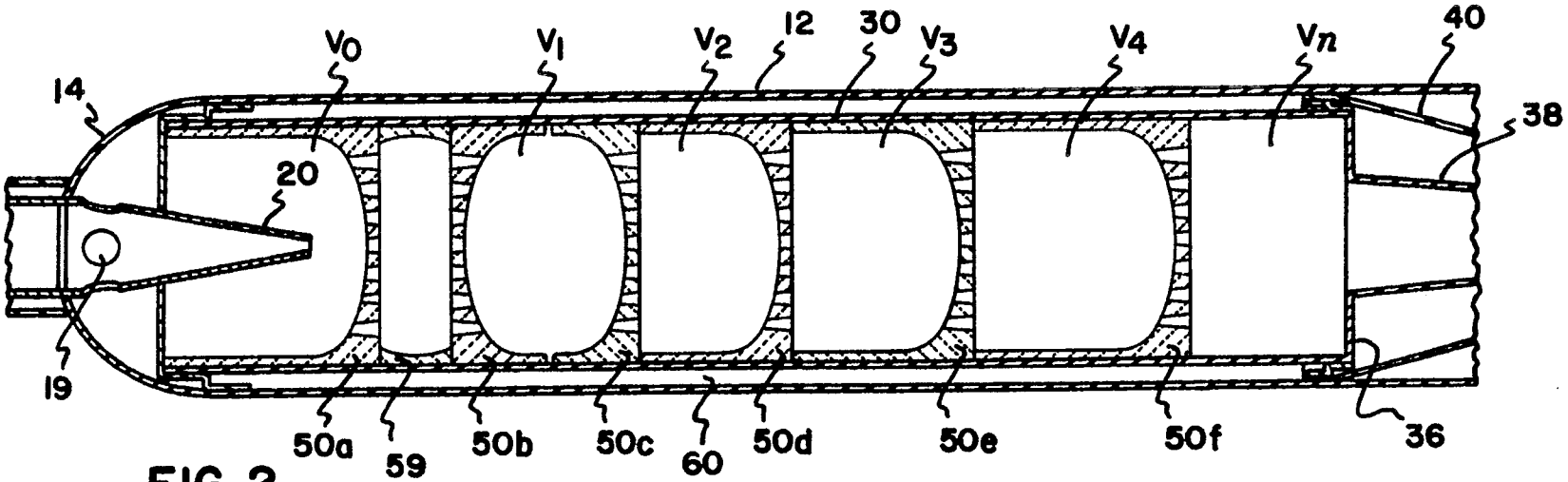
FIG. 2 is a schematic detailed view of the arrangement of the ceramic elements inside the silencer.

Starting from the end of the venturi nozzle 20, a set of porous ceramic modular diaphragms 50 is positioned in the tube 30, as shown schematically in FIG. 2.

The average distance d of the diaphragms is very closely equal to:

$$d=(0.6 \text{ to } 2)A \quad (6)$$

passing from small piston displacement engine to large displacement engines. However, said distance d is subject to variations which can be defined only experimentally in the laboratory by checking the pressure in the different chambers, with the engine running.

According to FIG. 3, the diaphragms 50, cup-shaped, have an external cylindrical form with a diameter strictly commensurate to the inside diameter of the metal tube 30, a substantially plane outer surface 51 and a concave inner surface 52, preferably with a parabolic profile so that the gas flow from the venturi nozzle always comes into contact with chambers having rounded surfaces without sharp corners so as to avoid the formation of vortexes and unwanted back pressure, phenomena, to ensure proper engine performance.

Each transversal wall 53 has, in its depth, a series of through-holes of various types, forms and dimensions, as shown by way of example in FIGS. 4, 5, 6, made with a circular section 54 or buttonhole shaped 56 or polygonally shaped 58 respectively, or in any mixed configuration whatsoever. Lengthwise, the holes have a frustum trend with the smaller base oriented towards the gas inlet so as to constitute in the gas flow direction a plurality of diverging ducts, as shown in FIG. 7, apt to favour, in succession, the expansion of said exhaust gases flowing from one chamber to the other. The angle of divergence alpha lies between 8° and 15°.

The ratio of the through-holes in each diaphragm over the total area may vary and is well defined; diaphragms with a greater ratio value, i.e. with more void spaces, will be fitted progressively toward outlet 38 of the converter where the exhaust gases are more expanded.

Length H in each diaphragm may also vary to permit to empirically define the volume of each successive chamber according to the volume of the exhaust gases produced by the engine, depending on the cubic capacity and the power of the engine.

FIG. 2 shows, by way of example, different possible arrangements for diaphragms 50. From left to right a diaphragm 50*a* is located with its concave part oriented towards the venturi nozzle 20 to form chamber $V_0$; then follows a pair of diaphragms 50*b* and 50*c* of the same type, oopposite to each other and having a length H not necessarily equal to that of diaphragm 50*a*, to form a chamber $V_1$. In this case, the pair of diaphragms 50*b* and 50*c* is spaced from diaphragm 50*a* by a ceramic ring 59 with concave inner surface. Further diaphragms 50*d*, 50*e*, 50*f*, all pointing in the same direction, form a succession of chambers $V_2$, $V_3$, $V_4$ . . . up to chamber $V_n$ just before the outlet of the catalytic silencer.

The diaphragms 50, prepared with different perforated surfaces and of different lengths H, are subjected to inhibition with known catalytic materials in order to cover both the surfaces of their porous structures and the surfaces of through-holes 54,56 and 58.

The exhaust gases flowing in contact with said treated surfaces and porous body of the diaphragms are depurated to conform to the purpose foreseen and they flow out, depleted of the unwanted harmful pollutants, at low temperature and silenced.

The circumferential walls of the diaphragms form an insulating barrier on the inside of the metal tube 30 surrounding it, which tube however is spaced by an interspace 60 from the outer housing 12, which interspace can also be filled in known manner with fiberglass or rock wool.

Figure 9:
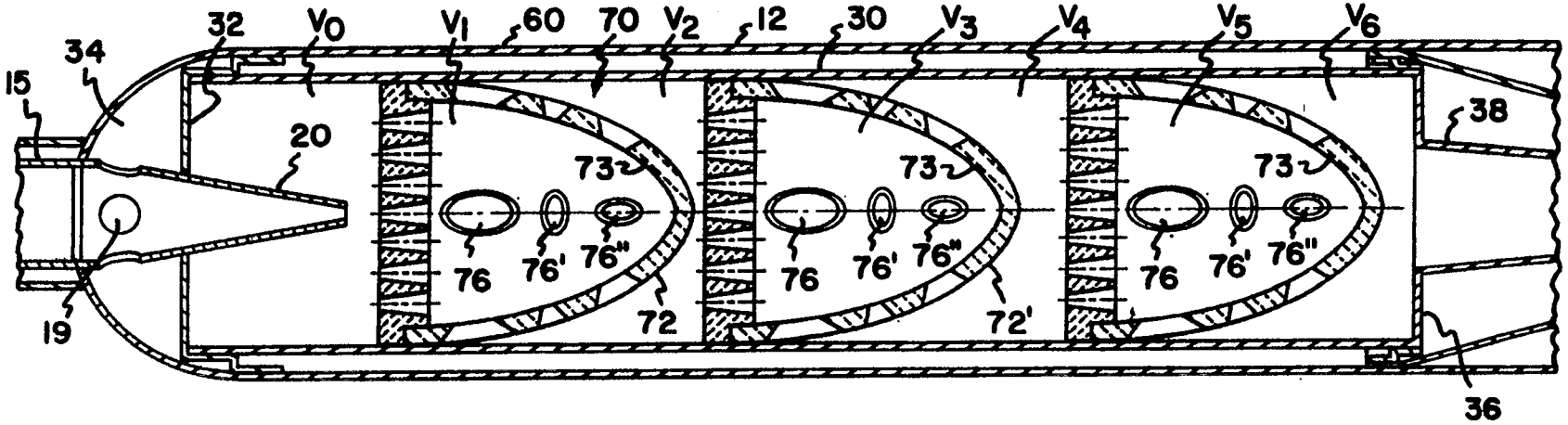
FIG. 9 is a detailed schematic view of the arrangement of the ceramic elements shown in FIG. 8.
Figure 8:
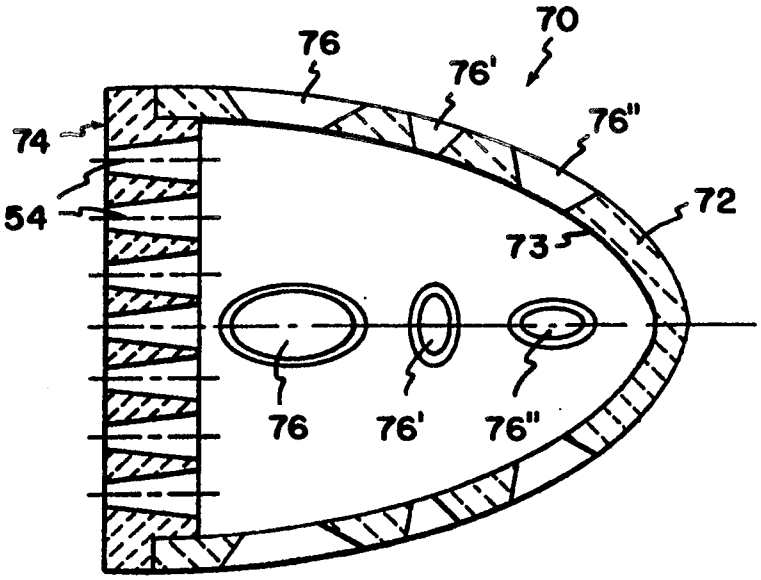
FIG. 8 is a cross-section of a further embodiment of the inventive porous ceramic diaphragm.
Figure 11:
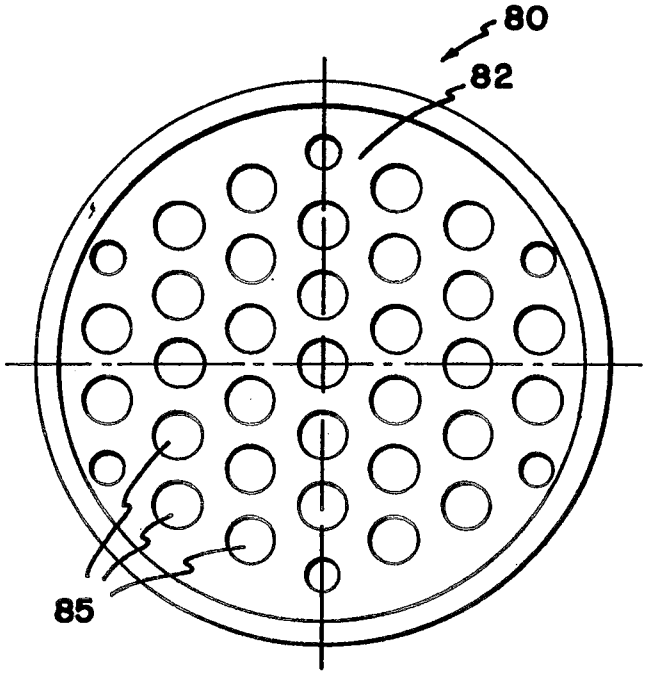
FIG. 11 is a front view of the diaphragm of FIG. 10 along direction XI of said FIG. 10.

FIG. 8 shows a further alternative embodiment of the diaphragms which is meant to reduce the number of catalytic elements to be introduced into tube 30 to permit a more rapid installation of the silencer. Diaphragm 70 may consist of an ogive 72 combined with a disc or plate 74 provided with holes of the type shown, by way of example, in FIGS. 4,5 and 6 for diaphragm 50 (i.e. 54,56 or 58). The two elements 72 and 74, having been pressed separately and treated with catalytic materials, in order to be securely connected to each other, are provided with a suitable joint, as shown, by way of example, in said FIG. 8, and moreover they are securely joined with other suitable means. Ogive 72 is provided with a plurality of holes 76,76',76'' . . . of any form, which allow the gases coming from the chamber $V_0$ (see FIG. 9) and flowing through plate 74 inside chamber $V_1$ (formed by ogive 72) to come into contact with the inner wall 73 of the ogive, undergoing a first depletion of the harmful chemicals. On flowing out from chamber $V_1$, the gases pass into chamber $V_2$, then into a further chamber $V_3$ inside ogive 72' and so on, into chambers $V_4$, $V_5$,$V_6$ . . . as it can be taken from said FIG. 9.

Figure 10:
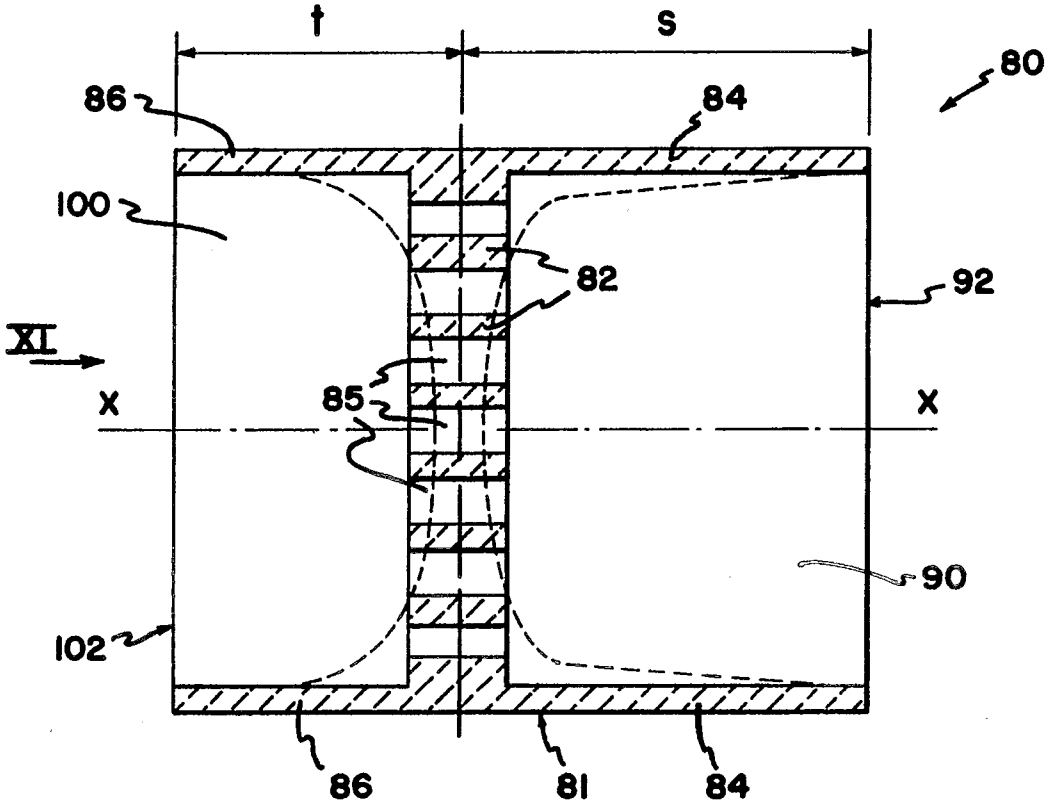
FIG. 10 shows the cross-section of a yet another embodiment of the inventive porous ceramic diagram.

A further advantageous variant of the diaphragm which can be used in combination with a plurality of units is shown in FIG. 10. Within the instant invention, the porous ceramic element consists of a body, generally identified as 80, the outer surface 81 of which is preferably cylindrical, and provided internally with a transversal diaphragm 82 to which are secured two flanges 84 and 86 forming two cavities 90, 100, having opposite apertures 92,102.

The adjacent bottoms of cavities 90 and 100, which delimit the diaphragm 82, are preferably concave and connected to their respective flanges, as shown by the dotted lines in FIG. 10, so as to prevent the formation of a sharp peripheral edge which may at times reduce the performance. The cavities 90 and 100 communicate with each other by means of a plurality of cylindrical and/or conical holes 85, passing through the diaphragm itself and which can be made in any form, number and dimensions, according to the specific needs and uses, and arranged according to the longitudinal axis x—x of element 80.

Flanges 84 and 86 of said element 80 can be of different heights s and t and they can afford a wide range of application possibilities allowing to conveniently attain, with just a few elements, a very vast range of volumes $V_0$, $V_1$, $V_2$ . . . of the successive chambers. Moreover, by using elements of the type indicated as 80 in FIG. 10, the chambers obtained by opposing the elements to each other always have bottoms connected yet without sharp edges on any part.

Although the invention has been amply illustrated and described referring to some preferred forms of embodiment, those skilled in the art will realize that various changes in form and detail may be performed without departing from the scope of protection of the invention as defined in the attached claims.

I claim:

1. A silencer, comprising:

a housing having an exhaust gas inlet, an exhaust gas outlet, and a semispherical head at the exhaust gas inlet;

a tapered fitting having one end connected to an exhaust manifold of an internal combustion engine and the other end connected to the semispherical head;

a tubular element being located in said housing;

a catalytic converter being fit in the tubular element;

said tubular element having an open end at the exhaust gas inlet end, the tapered fitting extending into the tubular element to form a venturi nozzle;

an opposite end of the tubular element being closed by a wall to which is connected an exhaust tube converging towards the outlet of the housing;

the catalytic converter disposed between the venturi nozzle and the wall of the tubular element including a plurality of modular diaphragm elements made of porous ceramic material impregnated with catalytic materials for depleting pollutants of an exhaust gas flow;

the porous ceramic modular diaphragm elements being curved-shaped diaphragms, each having a wall, an outer surface of the wall being plane and an inner surface being concave, the wall of said porous ceramic modular diaphragm elements being provided with a plurality of through-holes so as to prevent unwanted harmful back pressure phenomena, said through-holes diverging in a direction of the exhaust gas flow;

the porous ceramic modular diaphragm elements having different lengths, a chamber being defined between each two successive porous ceramic modular diaphragm elements so that a plurality of chambers are formed in a direction from the open end to the closed end of the tubular element; and a volume of each of the chambers being different from each other and the volume of the chambers being increased in the direction from the open end to the closed end of the tubular element.

2. The silencer according to claim 1, wherein the porous ceramic modular diaphragm elements are ogive shaped diaphragms, each of the ogive shaped diaphragms being joined to a plate at an open end of each porous ceramic modular diaphragm element, the plate provided with a plurality of through-holes, the through-holes diverging towards inside of the ogive shaped diaphragm in the direction of the exhaust gas flow.

3. The silencer according to claim 1, wherein the venturi nozzle has at least one lateral hole, the through-holes have different shapes so as to form a total area of through-holes varying from a minimum of 1.5 times up to 4 times an area of said at least one lateral hole of the venturi nozzle.

4. The silencer according to claim 1, wherein the venturi nozzle has at least one lateral hole, the through-holes have different shapes, so as to form a total area of the through-holes being 3 times an area of said at least one lateral hole of the venturi nozzle.

5. The silencer according to claim 1 further comprising at least one ceramic ring interposed between the diaphragm elements.

6. The silencer according to claim 1, wherein the diaphragm elements cup-shaped diaphragms.

7. A silencer, comprising:

a housing having an exhaust gas inlet, an exhaust gas outlet, and a semispherical head at the exhaust gas inlet;

a tapered fitting having one end connected to an exhaust manifold of an internal combustion engine and the other end connected to the semispherical head;

a tubular element being located in said housing;

a catalytic converter being fit in the tubular element;

said tubular element having an open end at the exhaust gas inlet, the tapered fitting extending into the tubular element to form a venturi nozzle;

an opposite end of the tubular element being closed by a wall to which is connected an exhaust tube converging towards the outlet of the housing;

the catalytic converter disposed between the venturi nozzle and the wall of the tubular element including a plurality of modular diaphragm elements made of porous ceramic material impregnated with catalytic materials for depleting pollutants of an exhaust gas flow;

the porous ceramic modular diaphragm elements, each having a wall and two lateral flanges disposed on each side of the wall of the diaphragm, the wall of each porous ceramic modular diaphragm element being provided with a plurality of through-holes so as to prevent unwanted harmful back pressure phenomena, said through-holes diverging in a direction of the exhaust gas flow;

the porous ceramic modular diaphragm elements having different lengths, a chamber being defined between each two successive porous ceramic modular diaphragm elements so that a plurality of chambers are formed in a direction from the open end to the closed end of the tubular element; and a volume of each of the chambers being different from each other and the volume of the chambers being increased in the direction from the open end to the closed end of the tubular element.

8. The silencer according to claim 4, wherein the venturi nozzle has at least one lateral hole, the through-holes have different shapes so as to form a total area of the through-holes varying from a minimum of 1.5 times up to 4 times an area of said at least one lateral hole of the venturi nozzle.

9. The silencer according to claim 4, wherein the venturi nozzle has at least one lateral hole, the through-holes have different shapes, so as to form a total area of the through-holes being 3 times an area of said at least one lateral hole of the venturi nozzle.

10. A silencer/catalytic converter, comprising:

an outer housing having an exhaust gas inlet, an exhaust gas outlet, and a semispherical head at the exhaust gas inlet end, a tapered fitting having one end connected to an exhaust manifold of an internal combustion engine and the other end connected to the semispherical head;

an inner housing concentrically located in the outer housing, the inner housing having an end opening toward the tapered fitting, and the other end of the inner housing being closed by a wall to which is connected an exhaust tube converging towards the outlet end of the outer housing;

the tapered fitting extending into the inner housing to form a venturi nozzle;

wherein a plurality of modular diaphragm elements which are made of porous ceramic material are disposed in the inner housing between the venturi nozzle and the wall, the porous ceramic material is impregnated with catalytic materials for depleting pollutants in an exhaust gas flow, and wherein either fiberglass or rock wool is filled between the outer housing and the inner housing;

the porous ceramic modular diaphragm elements being cup-shaped diaphragms, each having a wall, an outer surface of the wall being plane and an inner surface being concave, the wall of said porous ceramic modular diaphragm elements being provided with a plurality of through-holes so as to prevent unwanted harmful back pressure phenomena, said through-holes diverging in a direction of the exhaust gas flow;

the porous ceramic modular diaphragm elements having different lengths, a chamber being defined between each two successive porous ceramic modular diaphragm elements so that a plurality of chambers are formed in a direction from the opening end to the closed end of the inner housing; and a volume of each of the chambers being different from each other and the volume of the chambers being increased in the direction from the opening end to the closed end of the inner housing.

* * * * *